US007902450B2

(12) United States Patent
Haken et al.

(10) Patent No.: US 7,902,450 B2
(45) Date of Patent: Mar. 8, 2011

(54) METHOD AND SYSTEM FOR PROVIDING PRESSURE-CONTROLLED TRANSITIONS

(76) Inventors: Lippold Haken, Champaign, IL (US); Mark Smart, Champaign, IL (US); Edmund Eagan, Ottawa (CA)

( * ) Notice: Subject to any disclaimer, the term of this patent is extended or adjusted under 35 U.S.C. 154(b) by 709 days.

(21) Appl. No.: 11/653,074

(22) Filed: Jan. 13, 2007

(65) Prior Publication Data

US 2007/0234884 A1 Oct. 11, 2007

Related U.S. Application Data

(60) Provisional application No. 60/759,696, filed on Jan. 17, 2006.

(51) Int. Cl.

| | |
|---|---|
| ***G10H 5/00*** | (2006.01) |
| ***G10H 7/00*** | (2006.01) |
| ***G10H 3/00*** | (2006.01) |
| ***G10H 1/00*** | (2006.01) |
| ***G10H 1/18*** | (2006.01) |

(52) U.S. Cl. ..... 84/658; 84/600; 84/601; 84/645; 84/646; 84/744

(58) Field of Classification Search ..... 84/658, 84/600, 601, 645, 646, 744
See application file for complete search history.

(56) References Cited

U.S. PATENT DOCUMENTS

| | | | | | |
|---|---|---|---|---|---|
| 3,626,350 | A | * | 12/1971 | Suzuki et al. | 338/69 |
| 4,018,126 | A | * | 4/1977 | Walmann | 84/700 |
| 4,341,141 | A | * | 7/1982 | Deutsch et al. | 84/655 |
| 4,480,519 | A | | 11/1984 | Allen | |
| 4,558,623 | A | * | 12/1985 | Buchla | 84/689 |
| 4,852,443 | A | * | 8/1989 | Duncan et al. | 84/733 |
| 5,025,705 | A | * | 6/1991 | Raskin | 84/743 |
| 5,140,887 | A | * | 8/1992 | Chapman | 84/646 |
| 5,350,883 | A | | 9/1994 | Kitamura et al. | |
| 5,398,585 | A | * | 3/1995 | Starr | 84/646 |
| 5,425,297 | A | * | 6/1995 | Young, Jr. | 84/483.2 |
| 6,107,559 | A | | 8/2000 | Weinstock et al. | |
| 6,121,534 | A | | 9/2000 | Brush | |
| 6,150,592 | A | * | 11/2000 | Casper | 84/312 R |
| 6,703,552 | B2 | | 3/2004 | Haken | |
| 7,183,478 | B1 | * | 2/2007 | Swearingen | 84/609 |
| 7,538,268 | B2 | * | 5/2009 | Marcus | 84/723 |
| 2003/0015087 | A1 | * | 1/2003 | Haken | 84/658 |
| 2003/0145714 | A1 | * | 8/2003 | Moussa | 84/654 |
| 2007/0084331 | A1 | * | 4/2007 | Haken | 84/600 |
| 2007/0137468 | A1 | * | 6/2007 | Shibata | 84/723 |
| 2008/0034946 | A1 | * | 2/2008 | Aimi | 84/604 |
| 2009/0100992 | A1 | * | 4/2009 | Elion | 84/646 |

OTHER PUBLICATIONS

DC Music, "Antares Really Cool Stuff for Making Music," 8 pp., http://www.proaudiomusic.com/software/antares/antares.htm.
Sound On Sound: The World's Best Music Recording Magazine, "Automagic Alternative Uses for Auto-Tune," 4 pp., http://www.soundonsound.com/sos/aug99/articles/autotune.htm.
Doepfer Musikelektronik, "R2M Midi Ribbon Controller," 4 pp., http://www.doepfer.de/R2M.htm.

* cited by examiner

*Primary Examiner* — Jeffrey Donels
*Assistant Examiner* — Christina Russell
(74) *Attorney, Agent, or Firm* — Brinks Hofer Gilson & Lione

(57) ABSTRACT

Pressure-controlled transitions are provided for single-note lines in electronic musical instruments. By addressing the relative pressure for two or more pressure points on a playing surface, the method and system provides the performer with the ability to control transitions, such as retrigger, legato, and portamento, with greater precision and flexibility. In particular, the performer's fingers (or another source of pressure) are able to control the manner in which a note transitions from one pitch to another.

18 Claims, 6 Drawing Sheets

METHOD AND SYSTEM FOR PROVIDING PRESSURE-CONTROLLED TRANSITIONS

This application claims priority to United States provisional application Ser. No. 60/759,696, which was filed on Jan. 17, 2006.

BACKGROUND

1. Technical Field

The invention generally relates to electronic music controllers, and more particularly to pressure-controlled transitions played on electronic musical instruments.

2. Related Art

Electronic music controllers in which the positions of one or more fingers on a playing surface are detected come in a variety of formats. For example, a standard MIDI keyboard operates by having separate keys, each of which can be pressed by a user and represents a discrete pitch. The loudness of the pitch can be adjusted by the amount of pressure pressed down on the key (polyphonic aftertouch). In MIDI wind controllers, which emulate instruments such as saxophones or clarinets, pitches are similarly determined by the combination of keys depressed by the performer. Wind controllers continually monitor the airflow of the performer's breath, and the pressure of the performer's lips and teeth on the embouchure.

Continuous-pitch electronic controllers, such as Haken Audio™ Continuum™ Fingerboard, are also available. The Continuum Fingerboard is discussed in U.S. Pat. No. 6,703,552, which is incorporated herein by reference. The Continuum Fingerboard provides a continuous surface upon which a user can press one or more fingers. The Continuum Fingerboard then provides three-dimensional coordinates corresponding to focal points of the pressure provided by the user's fingers. This three dimension system may be applied such that left-and-right (x-axis) corresponds to pitch, up-and-down (z-axis) corresponds to loudness, and forward-and-back (y-axis) corresponds to timbre.

The Continuum Fingerboard can operate as a polyphonic or monophonic instrument. It can also employ pitch correction, such as that discussed in pending U.S. patent application Ser. No. 11/251,443, filed on Oct. 15, 2006 and herein incorporated by reference.

In such music devices, single-note lines can be performed with a variety of transitions between notes. If one finger is down, and another is pressed, the synthesizer can perform this as two consecutive single notes with different transitions between the notes. Any of the following transitions may be used:

Retrigger: The second note has an attack and decay; it sounds much like it would if the first note had not been played.

Legato: The second note has no attack or decay of its own; instead, it continues with the sustain portion of the first note, but jumps to the new pitch.

Portamento: The second note has no attack or decay of its own; instead, it continues with the sustain portion of the first note, but smoothly glides to the new pitch. The duration of the pitch glide is a separately configured parameter.

These types of transitions have been previously implemented both on analog and digital synthesizers. Traditionally, a foot switch or other control device has been used to indicate that the synthesizer should perform single-note lines, instead of playing polyphonically, when multiple fingers are down. In the traditional implementation in which the device is in single-note performance mode, the transition occurs as soon as the second finger depresses the key on the keyboard. These previous implementations leave much to be desired.

For example, in a standard MIDI keyboard environment, portamento can be applied by preprogramming the amount of time that should transpire for the transition from the first pitch to the second pitch. For example, a keyboard can apply a "slide up" from an A to an F by calculating intervening pitches and playing them according to a predetermined time setting. However, it is difficult for the user to control the speed or apply different pitch trajectories in a portamento transition. More particularly, the user cannot control the portamento time or pitch trajectory merely by the placement of his or her fingers on the playing surface.

BRIEF SUMMARY

By way of introduction, the preferred embodiments described below include a method and system for providing pressure-controlled transitions. Transitions in single-note lines may be controlled by finger pressure. Such, that if one finger is pressed down, and then a second is pressed down, the transition may be controlled by the relative pressures of the two fingers. Further, changes in the amount of pressure of each finger can affect the transition.

The preferred embodiments allow for the use of two or more fingers in creating single-line transitions. In this regard, if a user rolls his or her hand, the varying pressures in the fingers as the user's hand moves can be used to control transitions in the notes. The preferred embodiments allow for control of a transition by assessing pressure received from two fingers, all five fingers of one hand, all ten fingers of both hands, or any plurality of pressure points on a playing surface provided by any means.

The preferred embodiments may be used for different transition environments. For Retrigger and Legato, the transition may be controlled by identifying, at any given time, which finger has the highest pressure played. For example, if a first finger is pressed down and then a second finger is pressed down, the transition will not occur until the pressure in the second finger is greater than the pressure of the first finger. Where many fingers are pressed down, the transition will occur whenever a new finger becomes the finger with the highest pressure.

For Portamento, the transition begins when the second finger is pressed (the pitch glide begins), and ends when the first finger is released (the pitch glide is completed). The pressure of each finger, as well as the pitch of each finger, determines the pitch played during the transition. Long and short transitions may be performed under control of finger pressure, without changing any externally configured parameters. The pitch glide rate may vary within a single transition, depending on how the performer adjusts finger pressures. If many fingers are down, the pitches and the pressures of each finger can be combined to compute the total pitch.

The preferred embodiments provide a new approach to transitions in single-note lines for the Continuum Fingerboard, MIDI keyboards, or other keyboard-like devices. This new approach allows the keyboardist more control over the sound, and allows expressive possibilities that previously had not been available to keyboardists.

Although the preferred embodiments are described with respect to fingers being pressed on a fingerboard or keyboard surface, the invention may be applied in other contexts. For example, any controller that is able to measure multiple pressure points may be used.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

The preferred embodiments are discussed in conjunction with the operation of a Continuum Fingerboard. As one of skill in the art would appreciate, the embodiments can be readily applied in the same manner in a standard MIDI keyboard or other music controller. Similarly, the preferred embodiments are described with respect to searching for pressure created by a finger pressing down. Although it is contemplated that the most common form of pressure would be due to a finger pressing down, the same techniques could be applied with other sources, such as drum sticks, mallets, or a performer's feet. The pressure created need not be due to a finger pressing down.

Further, the embodiments discuss "pressure sensors." A pressure sensor is any device capable of measuring degrees of pressure created by an external element, such as one or more fingers. A pressure sensor may include an element in a MIDI keyboard that measures how hard a user pushes down a key or the manner in which the Continuum Fingerboard determines the focal point of pressure for each finger pressed down on the playing surface. A pressure sensor may include both hardware and software components, and need not be contained in a single physical structure. Further, a pressure sensor may comprise multiple pressure sensors acting in concert.

Similarly, the terms "pitch value" and "pressure value" may apply to a single pitch value or pressure value that corresponds to a single location. "Pitch value" and "pressure value" are also applicable to instances in which multiple data points or items of information are used to correspond to a location. "Pitch value" can correspond to a plurality of sensor readings used to identify a left-to-right direction on a playing surface and "pressure value" can correspond to a plurality of sensor readings used to identify an up-and-down direction on a playing surface.

The term "controller" is also used in the discussion of the preferred embodiments. A controller is any device that can receive inputs and generate an output signal that may be used to synthesis audible signals. The Continuum Fingerboard and a MIDI keyboard are examples of controllers. They receive tactile inputs from a user's fingers and output electronic signals from which a synthesizer generates audible sounds. Most commonly, a controller encodes information using the MIDI standard, with MIDI key numbers and pitch bends. Nonetheless, numerous other encoding methods may be used.

For the embodiments described below, X variables relate to pitch as measured by left-and-right finger placement and Z variables relate to pressure as measured by up-and-down finger placement. As one of skill in the art would appreciate, different nomenclature or coordinate systems may be substituted.

Figure 1:
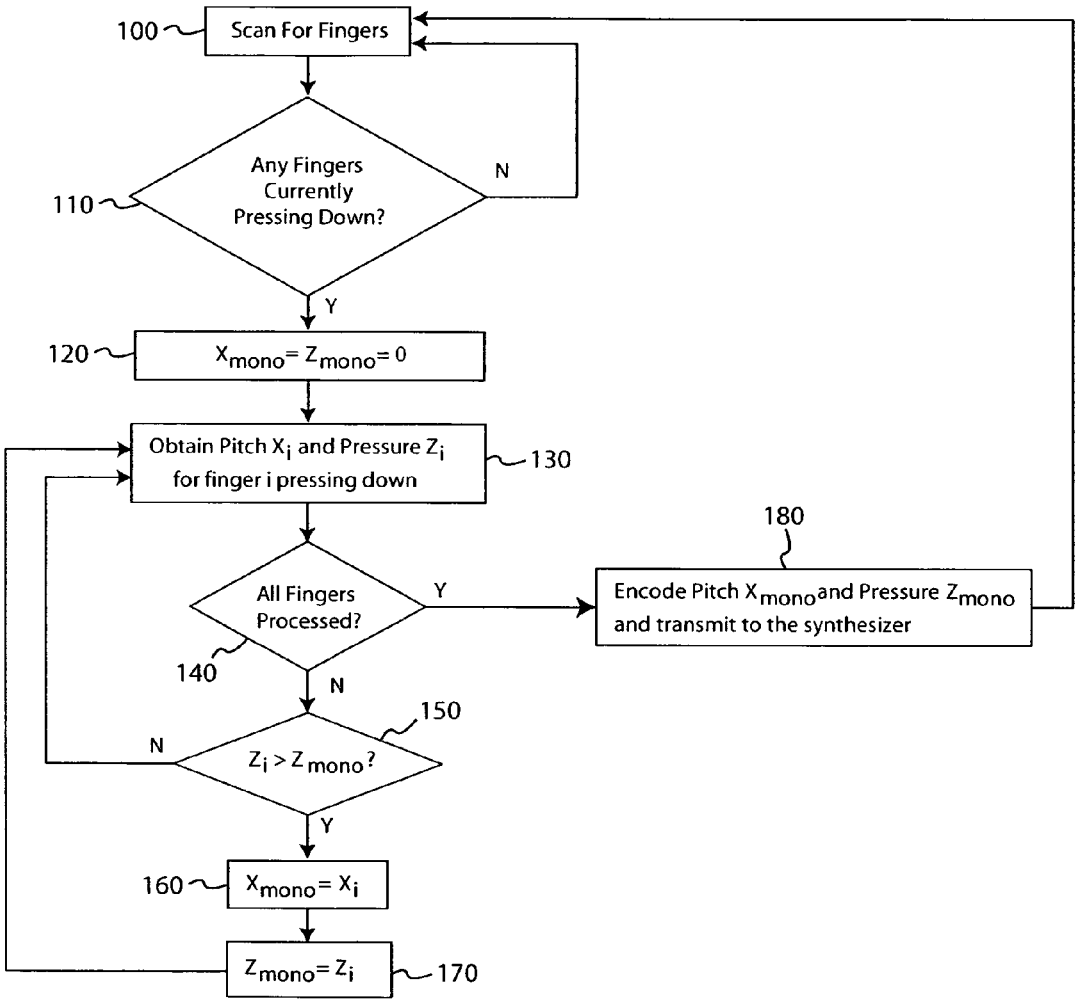
FIG. 1 is a flow chart of a method for performing legato and retrigger transitions.

FIG. 1 depicts a method for performing legato and retrigger transitions for single-note lines within a polyphonic environment. For legato and retrigger, the controller concludes the playing of one pitch and starts playing a new pitch. Where retrigger is applied, the first pitch terminates and a second pitch begins with a new attack in its sound waveform. Typically, the amplitude of the second pitch will start at zero. Where legato is applied, the controller will simply shift from the first pitch to the second pitch without initializing the amplitude of the second pitch at zero. In this regard, the second pitch does not present a new attack.

As shown in block 100, the device's pressure sensors are scanned. In block 110, the results from the pressure sensors are checked for any fingers pressing down. If there are no fingers pressing down, the system returns to block 100 to wait for a finger.

In block 120, $X_{mono}$ and $Z_{mono}$ variables are initialized to zero. $X_{mono}$ and $Z_{mono}$ are updated in blocks 160 and 170, discussed below.

In block 130, pitch $X_i$ and pressure $Z_i$ are obtained for a finger pressing down. This information is extracted from the sensors scanned in block 100. In block 140, the controller checks if all fingers have been processed.

If all fingers have been processed, the finger processing loop exits in block 180, in which pitch $X_{mono}$ and pressure $Z_{mono}$ are encoded and transmitted to the synthesizer. In the preferred embodiment, the encoding applies the MIDI standard, with MIDI key numbers and pitch bends. As one of skill in the art would appreciate, other encoding methods may be used.

In a preferred embodiment, retrigger may be encoded such that when the second finger reaches a pressure greater than the first, a MIDI Note Off will be transmitted for the first finger, and a MIDI Note On for the second finger. For legato, when the second finger reaches a pressure greater than the first, a Pitch Bend will be used to jump to the new pitch; no MIDI Note Off or MIDI Note On will be transmitted.

If there are more fingers to process, the controller checks if the current finger has the most pressure so far, as shown in block 150. This is done by determining if $Z_i$ is greater than $Z_{mono}$. If the current finger has the most pressure so far, the controller continues to blocks 160 and 170, in which the pitch for the finger is saved in $X_{mono}$ and the pressure for the finger is saved in $Z_{mono}$, respectively.

Figure 2:
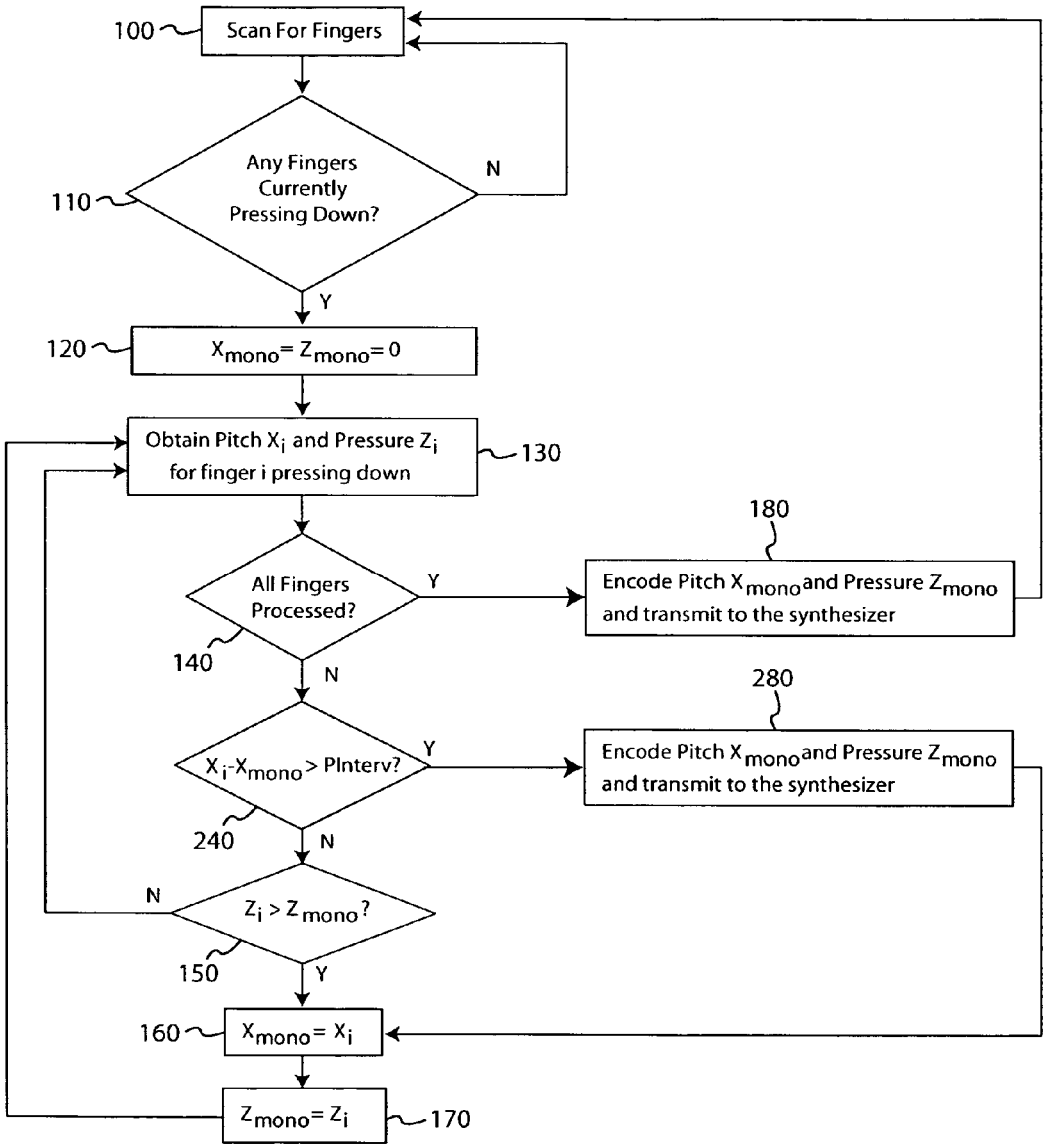
FIG. 2 is a flow chart of a method for performing legato and retrigger transitions in which pitch intervals are assessed.

FIG. 2 depicts a method for performing legato and retrigger transitions for single-note lines within a polyphonic environment in which pitch intervals are assessed. As in FIG. 1, the device's pressure sensors are scanned in block 100. In block 110, the results from the pressure sensors are checked for any fingers pressing down. If there are no fingers pressing down, the system returns to block 100 to wait for a finger.

In block 120, $X_{mono}$ and $Z_{mono}$ variables are initialized to zero. In block 130, pitch $X_i$ and pressure $Z_i$ are obtained for a finger pressing down. In this embodiment, the smallest $X_i$, i.e. the value that corresponds to the finger with the lowest pitch, is processed first. Higher $X_i$ values then follow. In other embodiments, the highest $X_i$ value may be applied first or the $X_i$'s may be arranged in a different order.

As in FIG. 1, the controller checks if all fingers have been processed in block 140. The finger processing loop exists when all the fingers have been processed.

If there are more fingers to process, the controller checks if the current pitch $X_i$ is within the pitch interval of $X_{mono}$. If it is outside of the pitch interval, processing is complete for $X_{mono}$ and the $X_{mono}$ and $Z_{mono}$ values are encoded in block 280.

If $X_i$ is not outside of the pitch interval, the controller determines if the corresponding pressure value $Z_i$ is greater than $Z_{mono}$. If it is not, the controller returns to block 130. If $Z_i$ is greater than $Z_{mono}$, then pitch $X_i$ is saved in $X_{mono}$ and pressure $Z_i$ is saved in $Z_{mono}$. The controller then returns to block 130.

By incorporating pitch interval assessment, the embodiment of FIG. 2 enables the controller to allow for single-note transitions while retaining the ability to provide a polyphonic output. If two fingers are close together, the controller can conclude that a transition is desired. Conversely, two fingers that are farther apart may be identified as two separate pitches, each of which may be audible at the same time. This also allows the controller to provide multiple single note transitions.

Figure 3:
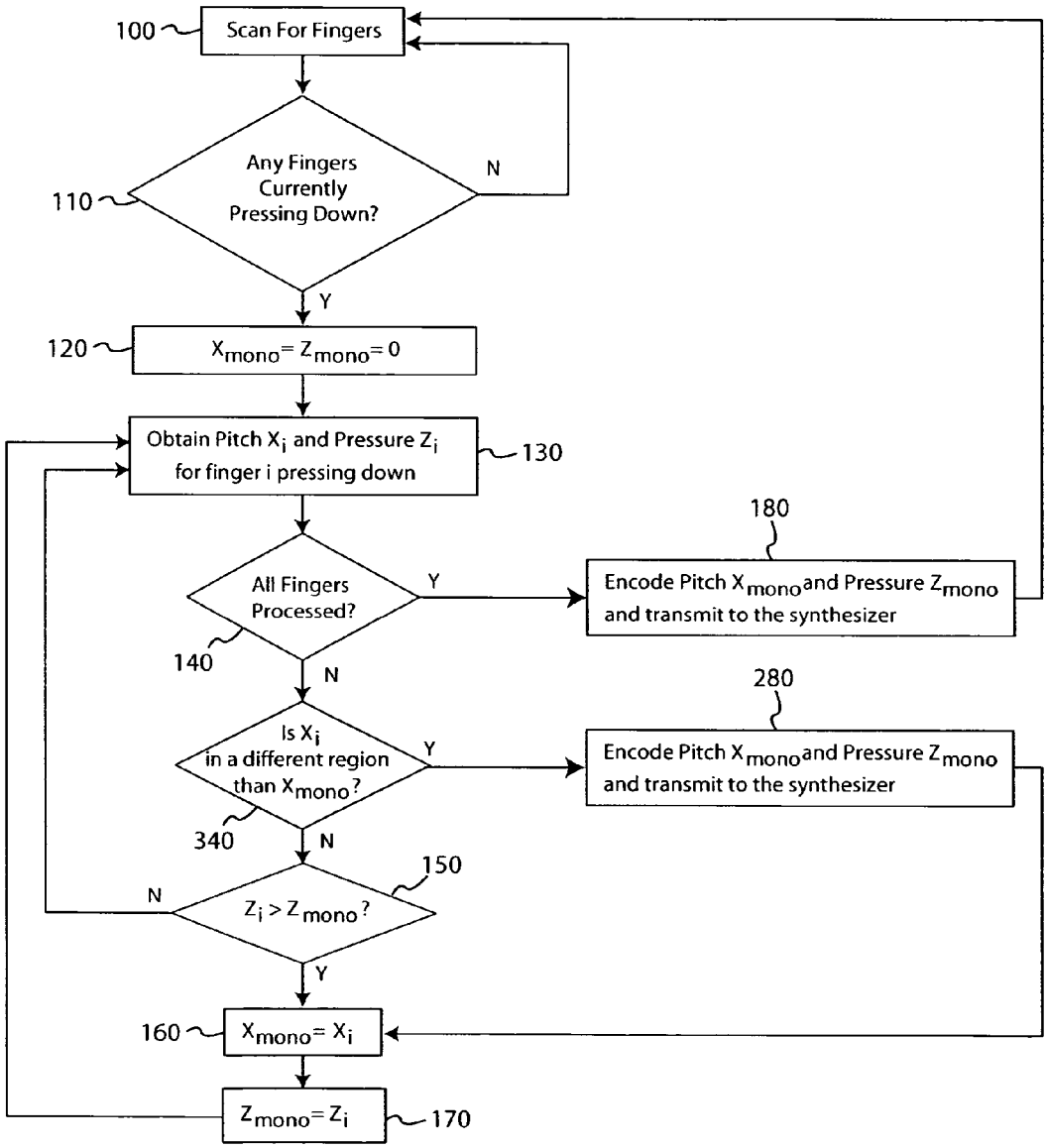
FIG. 3 is a flow chart of a method for performing legato and retrigger transitions in which regions of the playing surface are assessed.

As shown in FIG. 3, the ability to provide both single-note transitions and polyphonic outputs at the same time may also be achieved by dividing the playing surface into separate regions. Here, block 240 has been replaced with block 340. In this embodiment, the controller checks whether the current pitch value $X_i$ is in a different region of the keyboard as $X_{mono}$. The number of regions and the range of each region is a matter of design choice. If $X_i$ is in a different region, $X_{mono}$ and $Z_{mono}$ are encoded. If $X_i$ is not in a different region, then analysis of other fingers continues in block 130. By assessing if $X_i$ is in a different region than $X_{mono}$, the controller can differentiate between multi-pressure points in which transition is desired (locations in the same region) and pressure points in which separate notes are desired (locations in separate regions). As such, the controller can output multiple single-note transitions in different regions.

In this embodiment, the smallest $X_i$ is processed first. Higher $X_i$ values then follow. In other embodiments, the highest $X_i$ value may be applied first or the $X_i$'s may be arranged in a different order.

Figure 4:
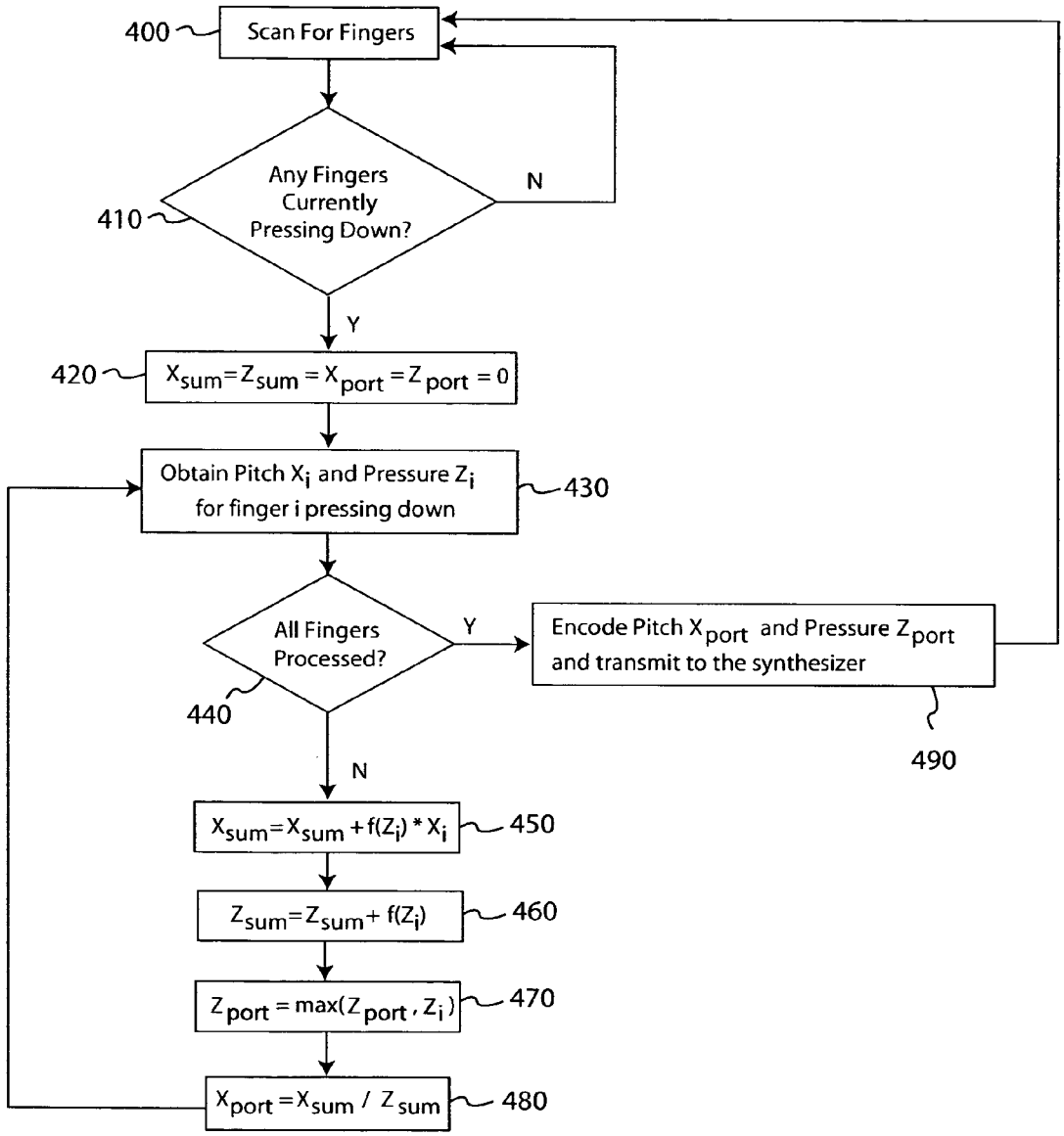
FIG. 4 is a flow chart of a method for performing portamento transitions.

FIG. 4 is a flow chart of a method for performing portamento transitions. For portamento, there is a "slide up" effect in which intervening pitches are played as the first pitch transitions to the second pitch. In the preferred embodiment, the "slide up" effect is controlled by measuring how hard the user is pressing on multiple keys and then calculating a weighted average of the pressure. Accordingly, as a user presses hard on a portion of the playing surface that corresponds to a higher pitch, the pitch of the outputted signal will slide up. In this regard, the user has control of the pitch trajectory while the pitch slides up simply by varying the pressure of the fingers on the playing surface.

In block 400, the device's pressure sensors are scanned. In block 410, the results from the pressure sensors are checked for any fingers pressing down. If there are no fingers pressing down, it returns to 400 to wait for a finger.

In block 420, the $X_{sum}$, $Z_{sum}$, $X_{port}$, and $Z_{port}$ variables are initialized to zero. They are updated in blocks 450, 460, 470, and 480 discussed below.

Pitch $X_i$ and Pressure $Z_i$ are obtained for a finger pressing down in block 430. This information is extracted from the sensors scanned in block 400. Block 440 checks if all fingers have been processed. The finger processing loop exits when all fingers have been processed.

In block 450, the pressure-weighted pitch contribution of this finger is added to $X_{sum}$. The pressure weighting function $f(Z_i)$ assists in making the pitch transition more musically pleasing for the listener. When a second finger is pressed, it is musically pleasing to "ease in" the pitch contribution of the second finger. Similarly, when a finger is about to be lifted from the surface, it is musically pleasing to "ease out" the pitch contribution of that finger.

The pressure weighting function $f(Z_i)$ may be a linear function, a polynomial function, exponential function, or some other function. In the preferred embodiment, pressure weighting function $f(Z_i)$ is implemented using the pressure cubed (pressure to the third power) when weighting pitches. By cubing the pressure, lighter pressure fingers contribute to the pitch much less than greater pressure fingers. The function may be expressed as:

$$f(Z_i)=Z_i^3$$

Accordingly, the computation in block 450 of $$X_{sum_new}=X_{sum_last}+f(Z_i)*X_i$$

becomes $$X_{sum_new}=X_{sum_last}+Z^{i3}*X_i$$

in a preferred embodiment in which the finger pressure values are cubed.

By cubing the pressure values, lower pressure fingers have decreased effect. This gives the musician the ability to play with greater precision. The high accuracy of a listener's ear can detect even small deviations in pitch. Accordingly, even a slight touch of another finger on a playing surface, without a pressure-weighting function, could affect the outputted pitch. By incorporating the weighting function, the musician can play with greater ease and control.

As one of skill in the art would appreciate, numerous other weighting functions can be applied. The function $f(Z_i)$ can be applied by squaring the pressure values, multiplying to the fourth power, etc.

Further, in other alternatives, $f(Z_i)$ need not be applied at all. In such an embodiment, block 450 would be applied as follows:

$$X_{sum_new}=X_{sum_last}+Z_i^3*X_i$$

In block 460, the pressure-weighted contribution of this finger is added to $Z_{sum}$. In an embodiment in which the $f(Z_i)$ operates by cubing the pressure values, the computation in block 460 of $$Z_{sum_new}=Z_{sum_last}+f(Z_i)$$

becomes $$Z_{sum_new}=Z_{sum_last}+Z_i^3$$

As noted above, the numerous different forms of $f(Z_i)$ may be applied, or alternatively $f(Z_i)$ may simply be replaced with $Z_i$.

Next, the controller assesses if the pressure for this finger is the highest-pressure finger so far in block 470. If it is the highest value, $Z_i$ is saved in $Z_{port}$.

In block 480, the portamento pitch $X_{port}$ is computed. This pitch is a combination of the pitches of each finger. $X_{port}$ is calculated by dividing $X_{sum}$ by $Z_{sum}$. Taking into account the summing actions that occur in blocks 450 and 460, the calculation of portamento pitch $X_{port}$ can be expressed as follows:

$$X_{port} = \frac{\sum f(Z_i) * X_i}{\sum f(Z_i)}$$

In an embodiment in which $f(Z_i)$ operates by cubing the $Z_i$ values, the calculation may be expressed as:

$$X_{port} = \frac{\sum f(Z_i) * X_i}{\sum f(Z_i)}$$

In other embodiments, additional parameters may be computed by pressure-weighted functions. For example, the Continuum Fingerboard tracks the Y position (front-back position) of each finger. During a portamento, the Y position may be computed as follows:

$$Y_{port} = \frac{\sum (Z_i^3 * Y_i)}{\sum Z_i^3}$$

Alternatively, if the weighting function $f(Z_i)$ is not desired, $Y_{port}$ may be computed as $$Y_{port} = \frac{\sum (Z_i * Y_i)}{\sum Z_i}$$

Returning to FIG. 4, pitch $X_{port}$ and pressure $Z_{port}$ are encoded and transmitted to the synthesizer in block 490. Encoding may be conducted using the MIDI standard, with MIDI key numbers and pitch bends, or other encoding methods. In the preferred embodiment, a series of pitch bends are used to glide the pitch to the new note.

Figure 5:
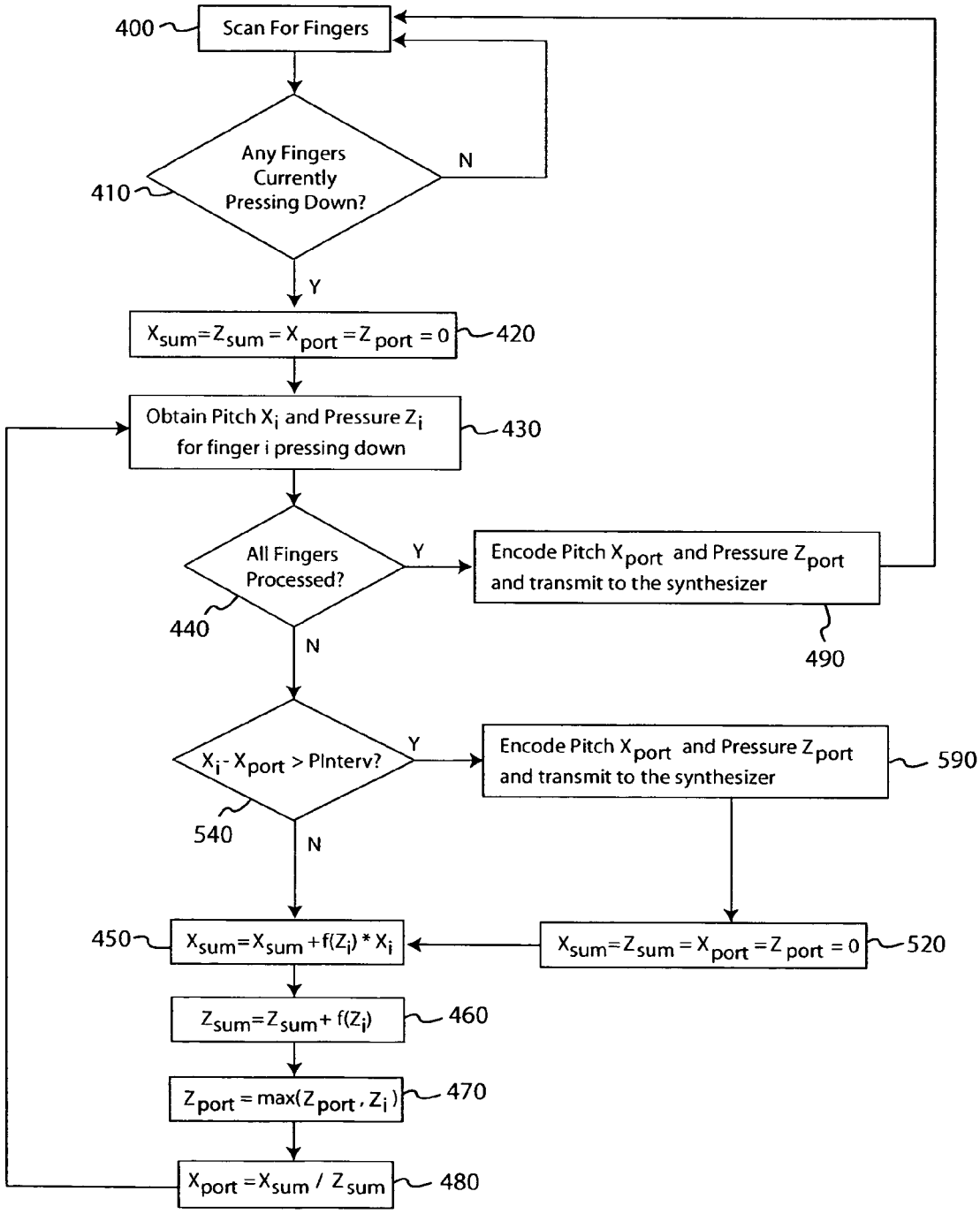
FIG. 5 is a flow chart of another method of performing portamento transitions in which pitch intervals are assessed.

As shown in FIG. 5, a pitch interval assessment may be incorporated to enable to controller to provide single-note transitions while retaining the ability to provide a polyphonic output. As shown in FIG. 5, if controller concludes that additional fingers remain to be processed in block 440, the control will then check in block 540 if the finger's $X_i$ is within the pitch interval of $X_{port}$.

In this embodiment, the smallest $X_i$, i.e. the value that corresponds to the finger with the lowest pitch, is processed first. Higher $X_i$ values then follow. In other embodiments, the highest $X_i$ value may be applied first or the $X_i$'s may be arranged in a different order.

If it is not outside of the pitch interval, the controller operates as in FIG. 4, proceeding by adding the pressure-weighted pitch contribution of this finger to $X_{sum}$ in block 450.

If it is outside of the pitch interval, processing has completed for $X_{sum}$ and $Z_{sum}$. The controller will then proceed to block 590.

In block 590, pitch $X_{port}$ and pressure $Z_{port}$ are encoded and transmitted to the synthesizer. Next, in block 520, the $X_{sum}$, $Z_{sum}$, $X_{port}$, and $Z_{port}$ variables are initialized to zero. The controller then proceeds to block 450.

Figure 6:
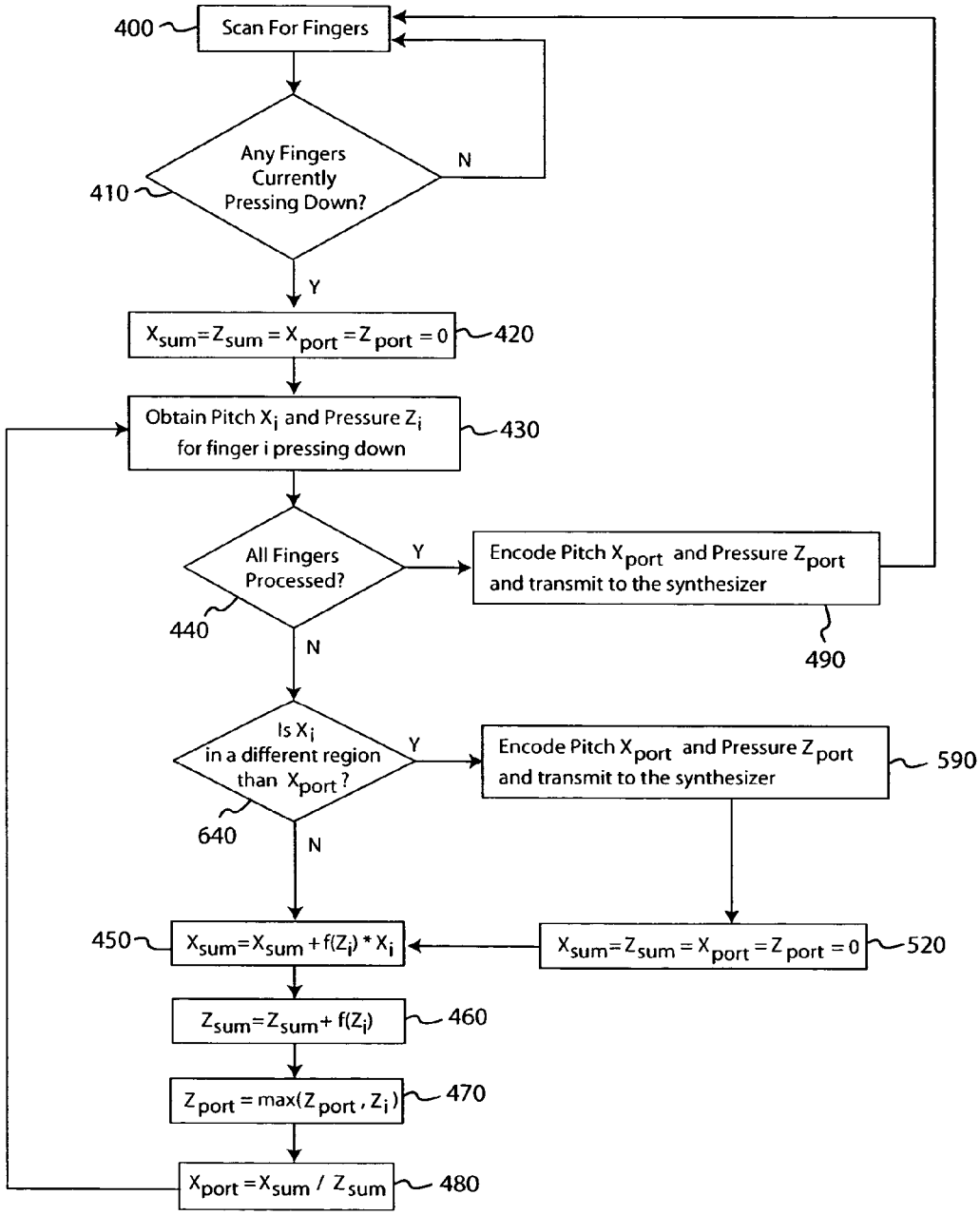
FIG. 6 is a flow chart of another method of performing portamento transitions in which regions of the playing surface are assessed.

As with the retrigger and legato embodiments, single-note portamento transitions and polyphonic output can be obtained by dividing the playing surface into separate regions, as shown in FIG. 6.

Here, block 540 has been replaced with block 640. The controller checks whether the current pitch value $X_i$ is in a different region of the keyboard as $X_{mono}$. The number of regions and the range of each region is a matter of design choice. If $X_i$ is in a different region, the controller proceeds to block 590. If it is not, the controller proceeds to block 450.

The smallest $X_i$, i.e. the value that corresponds to the finger with the lowest pitch, is processed first in this embodiment. In other embodiments, the highest $X_i$ value may be applied first or the $X_i$'s may be arranged in a different order.

The present invention and the above embodiments are not limited to controlling single-line note transitions through pressure received from two fingers. It is contemplated that more than two fingers, indeed any number of points of pressure on a playing surface, may be used to control a transition. In particular, as shown by block 140 of FIGS. 1-3 and block 440 of FIGS. 4-6, the embodiments disclosed include the act of assessing if any more fingers (i.e. pressure points) should be evaluated. If more fingers (pressure points) are to be evaluated, the process repeats. Any number of locations of pressure on a playing surface may be used.

In further alternative embodiments, a foot switch or other control device can be used to control whether single-note transitions should be applied. In such embodiments, the foot switch or other control switch can instruct the controller to turn on or off the ability to provide pressure-controlled transitions. Alternatively, the foot switch or external device could be used to vary the parameters of pressure-controlled transitions. For example, such devices could modify the pitch intervals discussed in the embodiments shown in FIGS. 2 and 5 or the regions discussed in the embodiments shown in FIGS. 3 and 6.

The above described embodiments describe single pitch and single pressure values for each finger. Other embodiments may employ multiple pitch values or multiple pressure values for each finger.

The methods described above may be implemented as software code or a set of instructions in conjunction with a processor. Alternatively, the methods may be implemented in hardware.

It is therefore intended that the foregoing detailed description be regarded as illustrative rather than limiting, and that it be understood that it is the following claims, including all equivalents, that are intended to define the spirit and scope of this invention.

The invention claimed is:

1. A method for providing pressure-controlled transitions comprising:

receiving a first set of data comprising a first pitch value and a first pressure values corresponding to a first location;

receiving a second set of data comprising a second pitch value and a second pressure values corresponding to a second location;

calculating an output pitch value using the first pitch and first pressure values in the first set of data and the second pitch and second pressure values in the second set of data as input data; and encoding the output pitch value for music synthesis, wherein the output pitch value is different than the first pitch and second pitch values.

2. The method of claim 1 further comprising:

receiving a third set of data comprising a third pitch value and a third pressure value corresponding to a third location;

wherein calculating an output pitch value comprises calculating an output pitch value using the first pitch value and first pressure values in the first set of data, the second pitch value and second pressure value in the second set of data, and the third pitch value and third pressure value in the third set of data as inputs to a weighting function.

3. The method of claim 1 wherein calculating an output pitch value comprises:

calculating a weighted average of pitch values based on the relative magnitudes of pressure values that correspond to the pitch values.

4. The method of claim 1 wherein calculating an output pitch value comprises performing the following calculation:

$$X_{out} = \frac{\sum f(Z_i) * X_i}{\sum f(Z_i)}$$

wherein $X_{out}$ represents the outputted pitch, $Z_i$ represents a pressure value, $X_i$ represents a pitch value, and $f(Z_i)$ represents the output of a weighting function applied to $Z_i$.

5. The method of claim 4 wherein $f(Z_i)$ comprises cubing each respective pressure value, such that the following calculation is performed:

$$X_{out} = \frac{\sum (Z_i^3 * X_i)}{\sum Z_i^3}.$$

6. The method of claim 1 further comprising:

outputting a pressure value.

7. The method of claim 1 further comprising:

receiving front-and-back position information for the first and second sets of data; and outputting a front-and-back position.

8. An electronic music controller comprising:

a playing surface;

a plurality of pressure sensors; and at least one processor operable to receive pressure information corresponding to locations on the playing surface, determine an output pitch value based on pressure information corresponding to two locations, and output the pitch value for music synthesis wherein the output pitch value is different from pitch values of the two locations.

9. The electronic music controller of claim 8 wherein the playing surface is a continuous surface.

10. The electronic music controller of claim 8 wherein the playing surface is a music keyboard.

11. A computer readable storage medium comprising a set of instructions for providing pressure-controlled transitions, the set of instructions to direct at least one processor to perform the acts of:

receiving a first set of data comprising a first pitch value and a first pressure values corresponding to a first location;

receiving a second set of data comprising a second pitch value and a second pressure value corresponding to a second location;

calculatinq an output pitch value using the first pitch and pressure values in the first set of data and the second pitch and pressure values in the second set of data as input data; and encoding the output pitch value for music synthesis:

wherein the output pitch value is different than the first and second pitch values.

12. The computer readable storage medium of claim 11 further comprising instructions to direct the at least one process to perform the act of:

receiving a third set of data comprising pitch and pressure values corresponding to a third location;

wherein calculating an output pitch value comprises calculating an output pitch value based on at least the pitch and pressure values in the first set of data, the pitch and pressure values in the second set of data, and the pitch and pressure values in the third set of data.

13. The computer readable storage medium of claim 11 wherein calculating an output pitch value comprises:

calculating a weighted average of pitch values based on the relative magnitudes of pressure values that correspond to the pitch values.

14. The computer readable storage medium of claim 11 wherein calculating an output pitch value comprises performing the following calculation:

$$X_{out} = \frac{\sum f(Z_i) * X_i}{\sum f(Z_i)}$$

wherein $X_{out}$ represents the outputted pitch, $Z_i$ represents a pressure value, $X_i$ represents a pitch value, and $f(Z_i)$ represents the output of a weighting function applied to $Z_i$.

15. The computer readable storage medium of claim 14 wherein $f(Z_i)$ comprises cubing each respective pressure value, such that the following calculation is performed:

$$X_{out} = \frac{\sum (Z_i^3 * X_i)}{\sum Z_i^3}.$$

16. The computer readable storage medium of claim 11 further comprising instructions to direct the at least one process to perform the act of:

outputting a pressure value.

17. The computer readable storage medium of claim 11 further comprising instructions to direct the at least one process to perform the acts of:

receiving front-and-back position information for the first and second sets of data; and outputting a front-and-back position.

18. The computer readable storage medium of claim 11 wherein encoding the output pitch value for music synthesis comprises providing data in MIDI format.

* * * * *